US006267696B1

(12) United States Patent
Mabe et al.

(10) Patent No.: US 6,267,696 B1
(45) Date of Patent: Jul. 31, 2001

(54) BASKETBALL FOUL-SHOT RETURN APPARATUS

(75) Inventors: Clarence Mabe, Gray; Jay T. Rockwell, Kingsport, both of TN (US)

(73) Assignee: New Innovations, Inc., Gray, TN (US)

( * ) Notice: Subject to any disclaimer, the term of this patent is extended or adjusted under 35 U.S.C. 154(b) by 0 days.

(21) Appl. No.: 09/455,655

(22) Filed: Dec. 7, 1999

(51) Int. Cl.[7] ..... A63B 69/00
(52) U.S. Cl. ..... 473/433; 237/397
(58) Field of Search ..... 473/422, 431–433, 473/434, 476–481; 273/348, 394, 396, 397, 407; 224/486; D21/702

(56) References Cited

U.S. PATENT DOCUMENTS

| | | |
|---|---|---|
| 1,924,811 | 8/1933 | Schulz . |
| 3,233,896 | 2/1966 | King . |
| 3,399,889 | 9/1968 | Harry . |
| 3,901,506 | 8/1975 | Caveney . |
| 3,917,263 | 11/1975 | Wiley . |
| 4,291,885 | 9/1981 | Cohen . |
| 4,667,957 | 5/1987 | Joseph . |
| 4,786,371 | 11/1988 | Postol . |
| 4,838,549 | 6/1989 | Woodall . |
| 4,913,431 | 4/1990 | Jakobs . |
| 5,016,875 | 5/1991 | Joseph . |
| 5,171,009 | 12/1992 | Filewich et al. . |
| 5,312,099 | 5/1994 | Oliver, Sr. . |
| 5,368,292 | 11/1994 | Metz . |
| 5,540,428 | 7/1996 | Joseph . |
| 5,692,976 | 12/1997 | Yu . |

*Primary Examiner*—Jeanette Chapman
*Assistant Examiner*—Mitra Aryanpour
(74) *Attorney, Agent, or Firm*—Susan F. Johnston

(57) ABSTRACT

Disclosed herein is a basketball foul-shot return apparatus for use with an elevated basketball goal assembly. The apparatus includes (a) an elongated, rigid structure adapted for being adjacently positioned against the face of the backboard to receive the basket, the structure having a longitudinal axis perpendicular to the face of the backboard with a rearward end proximate to the backboard and a forward end distal to the backboard, the structure including a substantially rectangular frame and a hooking means connected to said frame, wherein the hooking means is adapted to engage the upper end of the backboard when the basket is received, and an elongated brace extending downwardly forward from a center point of the frame along the longitudinal axis to a forward end, and a rigid ball return mechanism; (b) first and second elongated arms connected to the upper end of said frame on opposite side of the longitudinal axis and positionable in a longitudinally extended position; and (c) a ball collection chute formed from a longitudinal web connected to the arms and to the frame. The present basketball foul-shot return apparatus is elevated above the court when positioned on the backboard and preferably has an absence of an elongated rigid support extending from the forward end of either of the arms.

11 Claims, 4 Drawing Sheets

BASKETBALL FOUL-SHOT RETURN APPARATUS

FIELD OF THE INVENTION

The present invention relates to a basketball rebounding apparatus and more particularly to a lightweight and optionally collapsible basketball foul-shot return apparatus.

BACKGROUND OF THE INVENTION

Basketball foul-shot return devices designed to return the ball to a point proximate the foul-shot position are useful in basketball practice and in arcade entertainment. Various types of ball retrieving apparatuses are known, but the type most closely simulating the rebounding of a basketball from the backboard directly to a player shooting the ball from the foul-shot position on a basketball court, or simulating a pass from another player to the foul-shot player is of present concern. Such type of foul-shot return apparatus generally has an elongated, upwardly-open ball collection chute adapted to retrieve balls rebounding from the basketball goal or backboard, but also adapted so that the balls shot into or near the basket are allowed to freely travel and bounce downwardly and forwardly through the chute to a forwardly located ball return mechanism proximate the foul-shot position. This type of device is hereinafter referred to as an "elongated open chute" type foul-shot return apparatus. Examples of elongated open chute foul-shot return apparatuses are disclosed in U.S. Pat. Nos. 4,838,549; 5,692,976; and 5,171,009. These three patents disclose foul-shot return apparatuses that are too cumbersome and heavy for a single player of average build to hang over a basketball backboard himself. Therefore, these previous foul-shot return apparatuses of the same type include rolling standards for easily moving the apparatus and aligning it in place with the backboard. Foul-shot return apparatuses including rolling or stationary standards are deleterious in that they tend to move out of position when during the intended use and are quite bulky for storage purposes.

In light of the above, it would be desirable to provide an elongated open chute type foul-shot return apparatus that is lightweight enough so that it can be easily hung over the top of a backboard by an average size person. Such a hanging elongated open chute foul-shot return apparatus would also need to be strong enough to resist bending the rigid members supporting the chute.

BRIEF SUMMARY OF THE INVENTION

The present invention is a basketball foul-shot return apparatus for use with an elevated basketball goal assembly including a backboard having a planar face and an upper end, and a basket extending forwardly from the face. The apparatus of the present invention comprises (a) an elongated, rigid structure adapted for being adjacently positioned against the face of the backboard to receive the basket, said structure having a longitudinal axis perpendicular to the face of the backboard with a rearward end proximate to the backboard and a forward end distal to the backboard, said structure including a substantially rectangular frame having a size sufficient to receive the basket, said frame having upper and lower rails, first and second parallel side rails having upper and lower ends, and a hooking means connected to said frame, wherein said hooking means is adapted to engage the upper end of the backboard when the basket is received, and an elongated brace extending downwardly forward from a center point of said lower rail of said frame along said longitudinal axis to a forward end, and a rigid ball return mechanism positioned transverse to said longitudinal axis and having an upper end and a lower end wherein the lower end is connected to the forward end of said brace;

(b) first and second elongated arms having a rearward end and a forward end wherein the rearward end of each said arm is connected to the upper end of said corresponding first and second side rails of said frame, wherein said arms are disposed in first and second essentially parallel planes lying on opposite sides of said longitudinal axis and positionable in a longitudinally extended position; and (c) a ball collection chute formed from a longitudinal web, said web having a rearward edge, a forward edge, and a pair of first and second opposed side edges, wherein said rearward edge is attached about the lower rail and first and second side rails of said frame, wherein said first and second side edges are attached to said corresponding first and second arms, said forward edge having a pair of first and second outer portions disposed on opposite sides of said longitudinal axis and a center portion disposed therebetween and intersected by said axis, wherein said center portion is attached to the lower end of said ball return mechanism and said first and second outer portions extend upwardly from said center portion to the corresponding forward ends of said first and second arms when said arms are positioned in said longitudinally extended position, wherein said basketball foul-shot return apparatus is elevated above the ground when positioned on the backboard.

DETAILED DESCRIPTION

Figure 2:
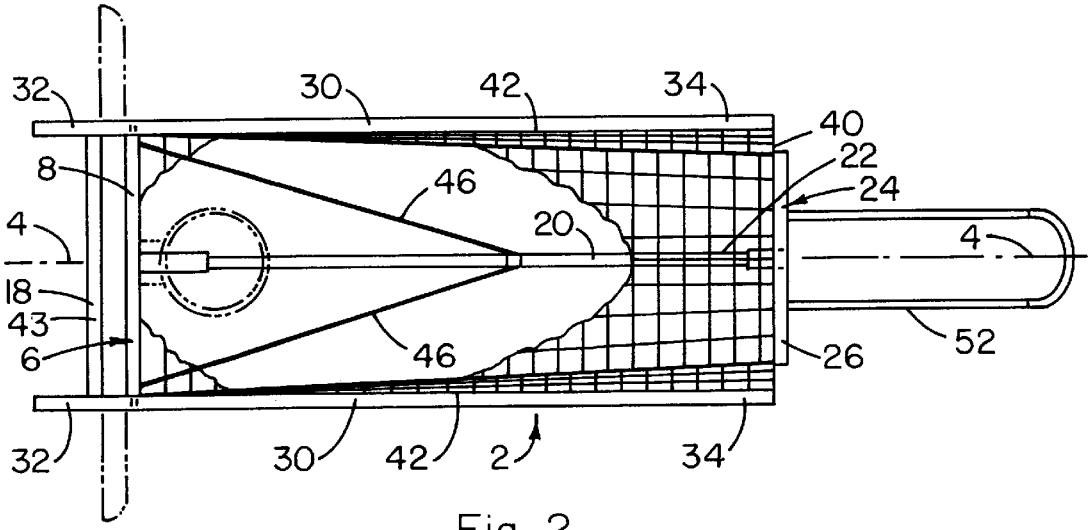
FIG. 2 is a top view of the embodiment shown in FIG. 1.

The present invention is a lighter-weight elongated open chute type basketball foul-shot return apparatus that is designed to be easily assembled and hung over a backboard by an average size person, even if the backboard is professional size and height. After use, the present foul-shot return apparatus may be quickly and easily collapsed and disassembled for storage in a relatively small space, thus enabling convenient transition of a basketball practice system using a single elevated basketball goal assembly. The present apparatus is more lightweight than any previous basketball foul-shot return apparatuses of the same type primarily due to the fact that there are no upwardly extending rails required for supporting the forward end of the ball collection chute. The presence of fewer rigid rails provides a lighter weight apparatus. Further, merely one forwardly extending longitudinal lower rail is required for supporting the lower part of the chute, instead of the two longitudinal rails required by previous elongated open chute foul-shot return apparatuses.

The basketball foul-shot return apparatus of the present invention is for use with an elevated basketball goal assembly including a backboard having a planar face and an upper end, and a basket extending forwardly from the face. The main components of the present apparatus are (1) an elongated rigid structure, (2) first and second elongated arms, and (3) a ball collection chute.

Referring to FIGS. 1–4 for illustration, the first main component of the apparatus of the present invention, the elongated rigid structure 2, is adapted for being adjacently positioned against the face of the backboard to receive the basket. The rigid structure 2 has a longitudinal axis 4 perpendicular to the face of the backboard with a rearward end proximal to the backboard and a forward end distal the backboard. The rigid structure of the present invention includes a substantially rectangular backboard frame 6 having a size sufficient to receive the basket. The frame 6 has an upper rail 8 and a lower rail 10, first and second side rails 12 each having an upper end 14 and a lower end 16, and a hooking means 18, with the hooking means 18 being adapted to engage the upper end of the backboard when the basket is received. The term "substantially rectangular" as used herein means that there are opposing upper and lower rails and opposing parallel side rails. Additional rails may be present if the intended functionality is equivalent. The rigid structure 2 of the present invention further includes an elongated brace 20 extending downwardly forward from a center point of the lower rail 10 along the longitudinal axis 4 to a forward end 22 of the brace. The rigid structure 2 still further includes a ball return mechanism 24 positioned transverse to the longitudinal axis 4 and having an upper end 26 and a lower end 28 wherein the lower end 28 is connected to the forward end 22 of the brace.

The second main component of the apparatus of the present invention, the first and second elongated arms 30, each have a rearward end 32 and a forward end 34. The rearward end 32 of each said arm is connected to the upper end 14 of the corresponding first and second side rails of the frame. The arms 30 are disposed in first and second essentially parallel planes lying on opposite sides of the longitudinal axis 4 and positionable in a longitudinally extended position.

The third main component of the present invention, the ball collection chute 36, is formed from a web having a rearward edge 38, a forward edge 40, and a pair of first and second opposed side edges 42. The rearward edge is attached about the lower rail 10 and first and second side rails 12 of the frame 6 of the rigid structure 2. The side edges 42 are attached to the corresponding first and second arms 30. The forward edge 40 has first and second outer portions disposed on opposite sides of the longitudinal axis 4 and a shorter center portion disposed therebetween on the longitudinal axis. The center portion is attached to the lower end 28 of the ball return mechanism 24 of the rigid structure 2. The first and second outer portions of the forward edge 40 extend upwardly from the center portion to the corresponding forward ends 34 of the first and second arms when the arms are positioned in a longitudinally extended position.

Figure 1:
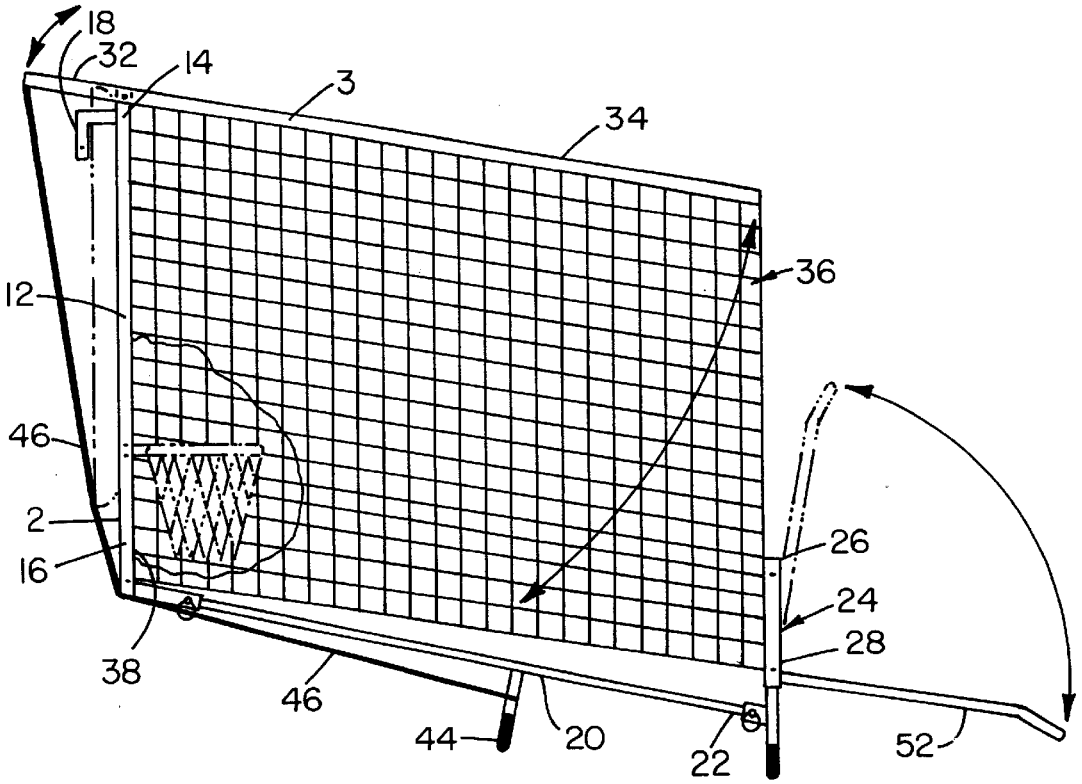
FIG. 1 illustrates a left side view of an embodiment of the present foul-shot return apparatus designed for use with a non-professional size backboard and having a cord-type locking means for securing the arms in a raised position.
Figure 3:
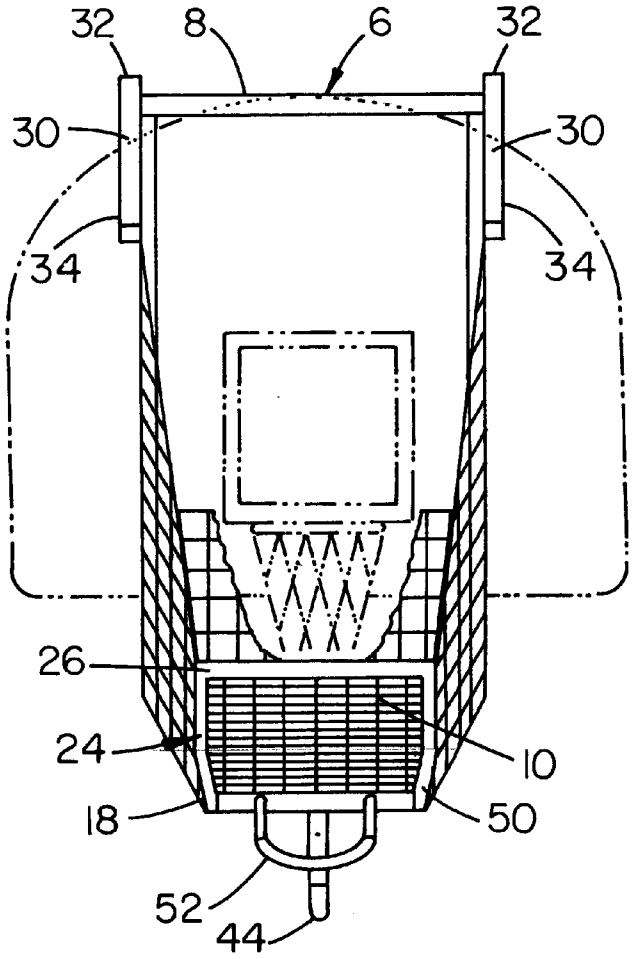
FIG. 3 is a front view of the embodiment shown in FIG. 1.
Figure 4:
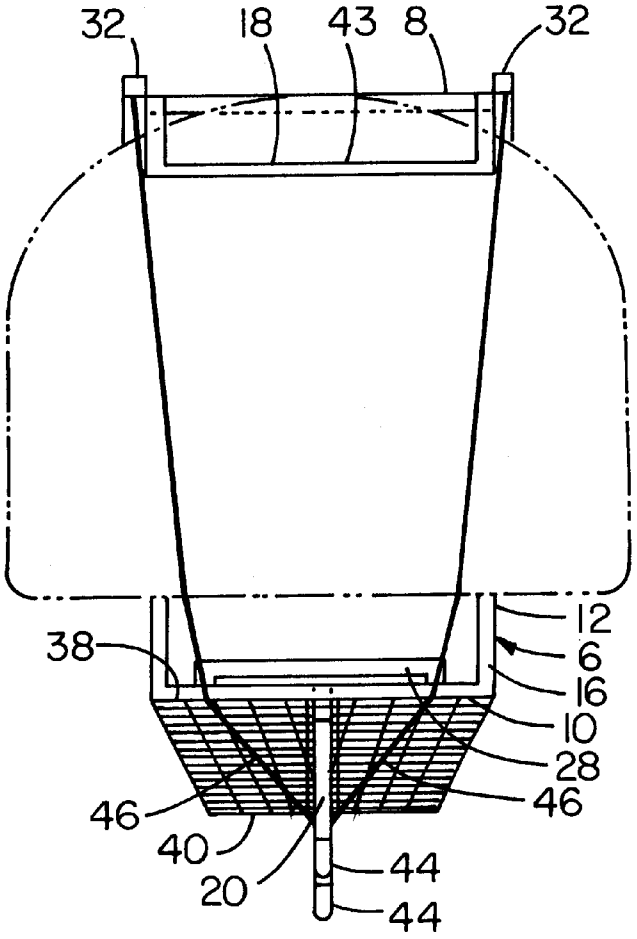
FIG. 4 is a rear view of the embodiment shown in FIG. 1.
Figure 5:
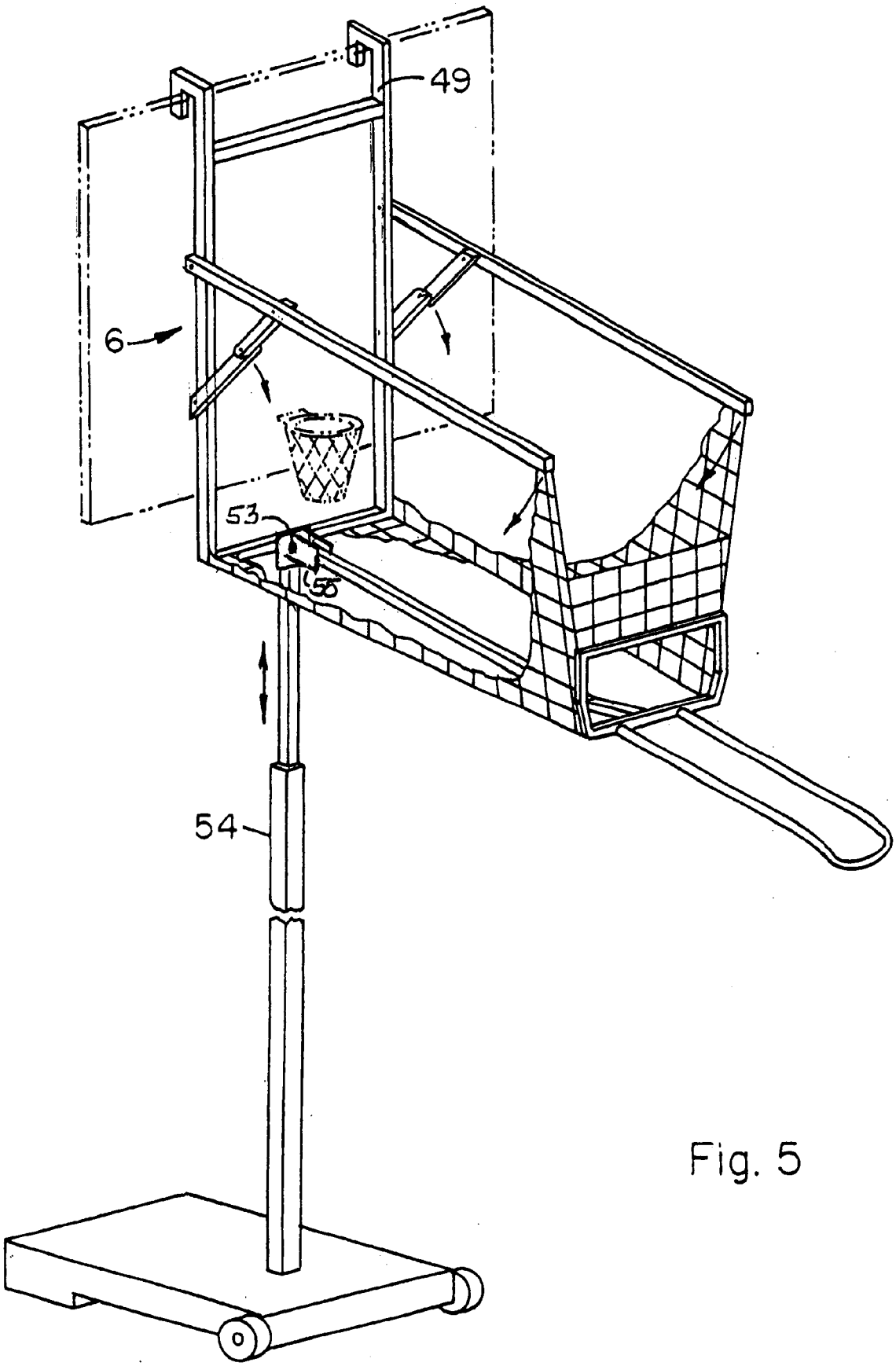
FIG. 5 is a front aerial view of an embodiment of the present foul-shot return apparatus designed for use with a professional size backboard and having a rigid locking hinge type locking means for securing the arms in a raised position, and having a standard.
Figure 6:
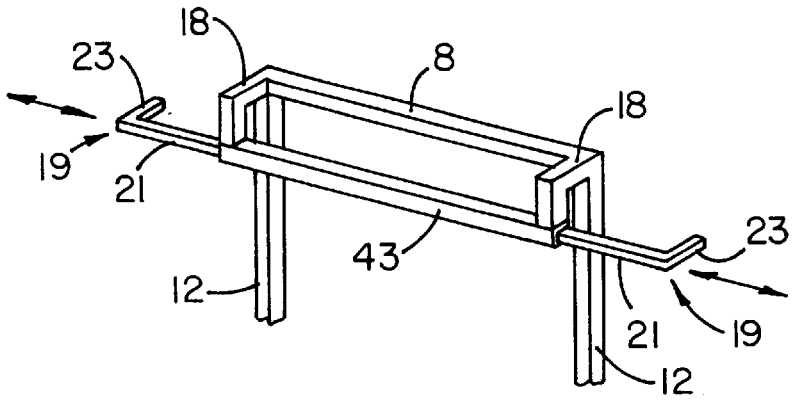
FIG. 6 is a rear aerial view of the hooking means of the present invention equipped with a pair of L-shaped horizontal movement preventors.

The ball return mechanism 24 of the rigid structure 2 may be a mechanism designed for simply retaining balls, such as those typically used in arcade settings, or else a mechanism designed to simulate basketball official passing the ball toward the player standing at the foul-shot position, as shown in FIGS. 1–5. Both types of return mechanisms are useful, depending on the particular application. The preferred ball return mechanism 24 is an assembly including a ring 50 defining an orifice having a size sufficient to receive a basketball and a return ramp 52 connected to the lower end of the ring as shown in FIG. 1. It is critical that the ring have a shape and size adapted to direct the ball onto the return ramp instead of allowing the ball to fall directly to the floor. Such ring shape is preferably substantially circular or square with a diameter not exceeding the diameter of the ball by more than about 6 inches. The return ramp 52 extends downwardly forward from the ring to provide transport of the basketball through the return mechanism to a point proximate the foul-shot position, thus simulating a bounced toward the shooter by a basketball game official standing under the goal. Such return ramp 52 is preferably pivotably connected to the ball return ring in a manner so that the downwardly forward extending ramp may be pivoted upwardly to a position that obstructs the passage of a basketball through the orifice of the ring. Accordingly, such a pivoting return ramp can be adjusted to serve as a rebounding device, as shown in FIG. 1 or as a device for retaining the ball behind the ball return ring, as shown in FIG. 6.

It is a critical aspect of the present invention that the basketball foul-shot return apparatus has no rigid member extending upwardly from the rigid structure 2 or from the court to the forward end 34 of the arms. All previous elongated open chute type foul-shot return apparatuses have included rigid members providing support to the forward end of the arms to keep the arms from bending during use. However, the inventors have found that the particular construction of the present rigid structure 2 and the relationship between the arms 30, the rigid structure 2, and the chute 36 provide a lighter weight foul-shot return apparatus having surprisingly high strength and flexibility to withstand the repeated force incurred from basketballs traveling through the foul-shot return apparatus. Thus, no supportive rigid members directly connecting the forward end 34 of the arms to the ground or to a lower portion of the apparatus are required. The lack of such supporting members further provides a lighter weight apparatus.

The frame 6 of the rigid structure 2 includes a hooking means 18 adapted to engage the upper end of the backboard when the basket is received. The hooking means 18 is preferably a plurality of hooks located on opposite sides of the longitudinal axis 4 on the frame 6 along a line essentially parallel to the upper and lower rails 8,10 of the frame, so as to provide more balance and stability, with two opposing hooks being more preferred for most applications. The hooks may be of any design sufficiently adapted to cup the upper end of the backboard so that the weight of the foul-shot return apparatus is supported by the backboard. A suitable hook designed to fit over a rectangular backboard extends rearwardly from the frame to a point where it extends downwardly to form a bend designed to cup the upper end of the rectangular backboard. Instead of bending downwardly, the hook may alternatively extend rearwardly from the frame then extend inwardly toward the center of the backboard to form a bend designed to better cup the fan shaped edge of a fan-shaped backboard. The entire fan shaped edge is considered as the upper end of the backboard.

The hooking means of the present apparatus is more preferably designed for interchangeable use of the apparatus with a basketball goal having a rectangular or fan-shaped backboard. A particularly useful interchangeable use design for the hooking means is shown in FIGS. 1–4 wherein the hooking means includes two hooks oppositely positioned hooks on the frame 6, with each of the two hooks extending rearwardly from the frame to a first point where the hook extends downwardly to a second point at which the hook extends traversely inward, preferably forming a transverse bar 43 between the two hooks. In addition to being useful on both rectangular and fan shaped backboards, such a hooking means provides increased ease in hanging the foul-shot return apparatus on a backboard.

The upper end of a professional size backboard is normally about 3 feet above the basket rim with 1 foot lying below the rim, whereas a nonprofessional size backboard may be about 15 to about 25 inches above the basket rim, with about 6 inches lying beneath the rim. Instead of correspondingly increasing the overall dimensions, and thus the weight, of the version of the present foul-shot return apparatus when designed for use with a professional size backboard compared to the version useful for a non-professional size backboard, the increased size requirements can mostly be reached by merely increasing the length of the upwardly extending portion of the hook positioned adjacent the face of the backboard, designated herein as the "hook tail" 44. An example of an embodiment of the present apparatus designed for use with a professional size backboard is shown in FIG. 5, whereas FIGS. 1–4 illustrate an embodiment of the apparatus designed for non-professional use.

Still another useful embodiment of the hooking means of the present invention is shown in FIG. 6. In this embodiment, the hooking means includes a pair of horizontal movement preventors 19 positioned opposite each other on the hooking means for maintaining the foul-shot return apparatus in proper horizontal position on the backboard. Each of the two horizontal movement preventors 19 are essentially L-shaped and includes a first member 21 that extends outwardly from a portion of the hooking means disposed on the rearward side of the backboard and a second member 23 extending forwardly from the first member to a point forwardly beyond the face of the backboard. The first member 21 is preferably adjustable in length so as to provide a snug fit on the backboard. As shown in FIG. 6, the lengths of the first members 21 are most preferably adjustable via nesting inside the transverse bar 43.

In the preferred embodiment of the present foul-shot return apparatus, the elongated brace 20 of the rigid structure component has a downwardly directed handle 44, or pair of handles, useful for raising the apparatus to the vertical level needed for hanging the frame over a backboard. A suitable handle provides a means for an individual player to raise the apparatus to a height required for hanging the apparatus atop the backboard. The handle 44 has an upper end connected to the brace and extends downwardly to a lower end disposed at an elevated position, not contacting the ground. For the sake of minimizing the total weight of the apparatus, the length of the handle 44 should be limited to the length required for raising the apparatus high enough to cup the hooking means 18 over the upper end of the backboard. A suitable length for the handle designed for hanging a foul-shot return apparatus over a professional or non-professional size backboard would be about 1 to about 1.5 feet.

The foul-shot return apparatus of the present invention is preferably collapsible. The collapsible embodiment of the present invention collapses to approximately the size of a collapsed card table for easy storage and portability. The primary feature of the collapsible embodiment of the present apparatus is that the first and second arms 30 are pivotally connected to the corresponding first and second side rails 12 of the frame so that the arms 30 pivot through the pair of parallel planes in which they lie. Each arm is preferably connected to the outer side of the corresponding frame side rail 12 with a pivot pin, as shown in FIG. 5. These pivotal arms are equipped with a means for locking the arms into a static extended position when the apparatus is in use. The arms are taken out of their extended position for collapsing for storage. The locking means is preferably a first and second locking means connected to the rearward end 32 of the corresponding first and second arms and engageable with the rigid structure at some point, preferably on the upper end of the frame, so as to lock the arms into the longitudinally extended position required for the web to form a useful ball collection chute. A useful longitudinally extended arm position is nearly parallel to the longitudinal axis, with "nearly parallel" encompassing arm extensions forming an angle of up to about 30° above and up to about 30° below a line parallel to the longitudinal axis 4.

In order for the locking means to be lightweight, any supportive elongated rigid member extending downwardly from the forward end of either arm 30 to either a lower portion of the apparatus or to the court is specifically excluded as part of the present invention. Further, in order to eliminate unnecessarily lengthy rigid members, it is preferable that no elongated member supporting the arms lie substantially parallel to the face of the backboard. Such an elongated member would necessarily be lengthy and relatively heavy. Rather, the types of locking means suitable in the present apparatus include the class of elongated flexible lightweight connectors referred to herein as cords 46 and relatively short rigid locking hinges 48 adapted to connect at one end to the frame and at the other end to the rearward end 32 of an arm 30. Such a rigid locking hinge preferably extends between the upper portion of the frame and the rearward end of the arm to form an angle between about 30 to 60 degrees, more preferably about 40 to about 50 degrees with the face of the backboard, when in a locked position. A suitable rigid locking hinge must be capable of supporting the weight of an arm 30 in a raised position when locked.

An example of a suitable locking hinge is the elbow locking hinge commonly used for connecting legs to the top of a collapsible card table. Such an elbow type locking hinge 48 is most preferably connected to the arm and to the corresponding side rail of the frame in a manner so that a player can push upwardly on the hinge to slidingly engage the hinge into a locked position. An elbow type locking hinge would be most useful for a professional size foul-shot return apparatus if used in conjunction with a push rod to help the player reach high enough to engage the hinge. The "elbow" would be pushed upward to lock and pulled downward to collapse the arms. Other types of locking hinges includes retractable and periscoping lockable shafts and various sliding length arms that are lockable by way of a pin, a clamp. and the like.

The locking means for locking the arms in the extended position may also be a cord. The term "cord", as used herein refers to any type of cord, cable, strap, string, fiber, rope and such. It is preferable that the cord be slightly elastic so as to absorb part of the shock of the force of a basketball travelling through the foul-shot return apparatus. The first end of the cord is connected to the arm 30, preferably at the rearward end 32 of the arm. The second end of the cord is attachable to a point on the rigid structure. A preferred embodiment of the present invention includes a brace 20 having a handle 44 adapted to additionally serve as a post upon which the second end of the cord may be secured when the cord is wrapped behind and under the rearward end of the apparatus as shown in FIGS. 1–4. When the cord is wrapped behind and beneath the rigid structure, the pivotable arms may be raised from a collapsed position to a longitudinally extended position by pulling the second end of the cord in a forward direction. The arms may be locked into a static raised position by securing the cord on the rigid structure, preferably on the handle. A cord type lock would be most useful for a foul-shot return apparatus designed to fit on a non-professional size backboard. Most players would find it difficult to assemble cord type locks on a professional size apparatus.

Another option of the present invention providing further collapsibility is that the brace 20 of the rigid structure 2 be separable from the backboard frame 6 or else collapsible against the frame when stored. The preferred collapsible embodiment of the present foul-shot return apparatus includes pivoting arms that collapse when not locked into position by the locking means and a removable brace as shown in FIG. 1. FIG. 5 illustrates a folding brace that is upwardly pivotal toward the frame about bolt 53 and is held in an extended position during use by a brace support 55. This embodiment is optimally equipped with a pin or clamp to secure the brace against undesired upward pivoting during use. Accordingly, the collapsible foul-shot return apparatus may be reduced to a convenient storage size.

The present invention further includes a method of assembling the preferred embodiment of the foul-shot return apparatus described above having pivoting arms 30 and a handle 44 protruding downwardly from the brace. The method of assembly includes the steps of (1) hanging the foul-shot return apparatus over a backboard by grasping the handle of the rigid structure and raising the apparatus to receive the basket through the frame and cupping the hooking means over the upper end of the backboard so that the apparatus is supported by the backboard, (2) raising the first and second arms to a position nearly parallel to the longitudinal axis, and (3) engaging the first and second locking means whereby locking the arms into the nearly parallel position.

The particular size of the present basketball foul-shot return apparatus is not critical as long as it is (1) sufficiently large enough to receive the basket while hanging over the upper end of a backboard via the hooking means, and (2) provides a ball collection chute longitudinally long enough to capture most balls shot proximate the backboard or basket when the first and second arms are raised to a point nearly parallel to the upper and lower rails of the backboard frame 6.

The preferred dimensions of a foul-shot return apparatus of the present invention designed for use with a non-professional size basketball goal assembly are as follows: a width of the upper and lower rails of the frame of about 33 to a about 40 inches, a height of the side rails of the frame of about 46 to about 52 inches, a longitudinal length of the arms of about 50 to about 70 inches, a longitudinal length of the brace of about 44 to 52 inches with a downward slope forming an angle of about 30 to about 50° with the court, the ball return ring having a diameter of about 12 to about 18 inches, and a ball return ramp having a longitudinal length of about 30 to about 42 inches and a downward slope forming an angle of about 10 to about 30° with the court.

The preferred dimensions of a foul-shot return apparatus of the present invention designed for use with a professional size basketball goal assembly are essentially the same as the preferred dimensions stated above for the non-professional sized assembly except that the hooking means has a longer hook tail 44 adding about 10 inches to the vertical length of the frame.

An additional optional feature that is particularly useful for the foul-shot return apparatus of the present invention designed for use with a professional size basketball goal assembly is a standard 54 resting on the basketball court and extending upwardly from the court to the rigid structure at a point along the longitudinal axis so as to support the foul-shot return apparatus above the court, as shown in FIG. 5. Such standard is preferably retractable and removably attached to the rigid structure so that the standard can be lowered and moved out of the way after the apparatus is lifted and hung over the backboard. It is most useful for the standard to be equipped with wheels or casters so that a player can roll the relatively heavier professional size foul-shot return apparatus from it's storage place to beneath the elevated basketball goal assembly and thereafter separate the standard from the foul-shot return apparatus just prior to hanging the foul-shot return apparatus over the backboard. Once the foul-shot return apparatus is hung over the professional size backboard, the standard may be moved away from the playing area.

Figure 7:
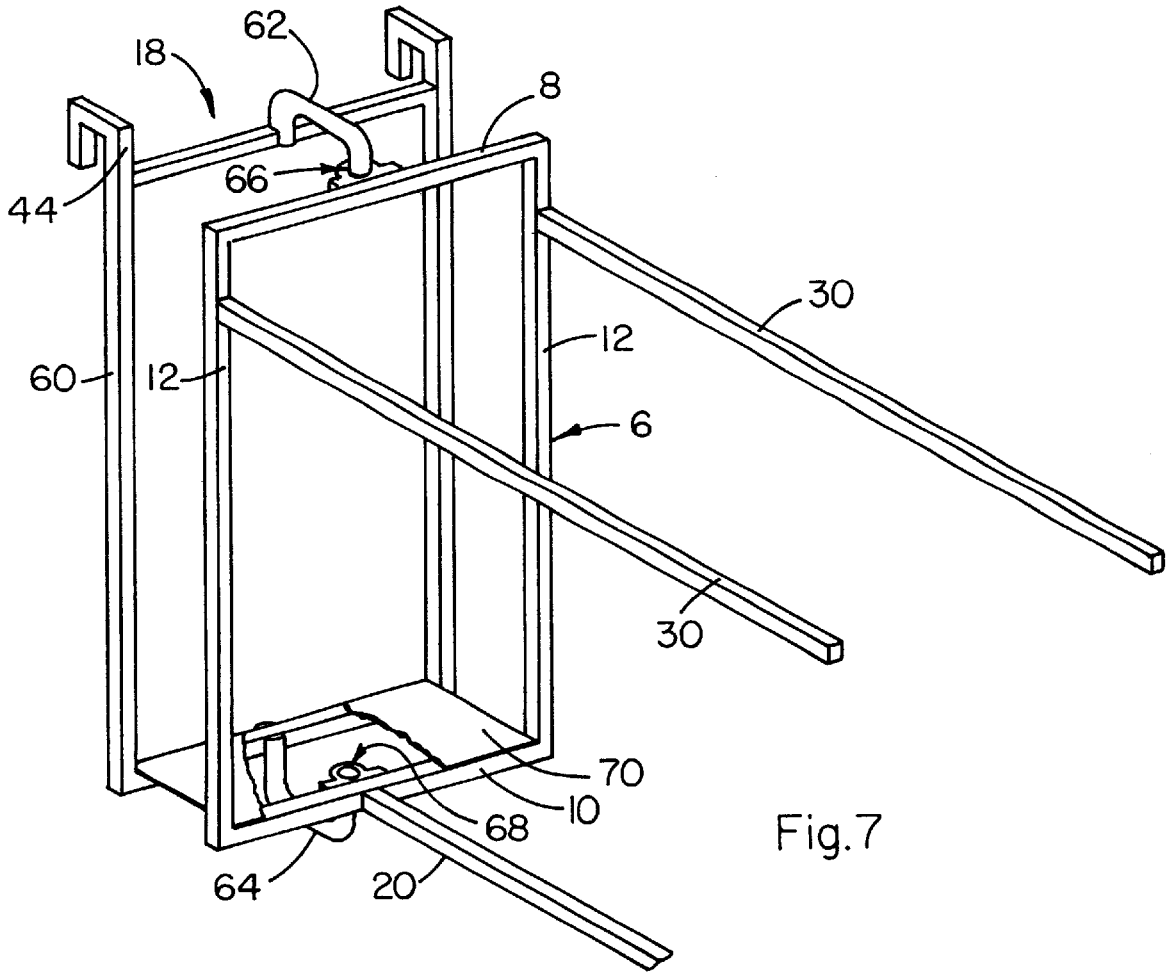
FIG. 7 a cut-away front aerial view of the embodiment of the present apparatus having a swivel frame.

A still further optional embodiment of the present invention is a swiveling foul-shot return apparatus designed to rebound balls thrown from various positions about the basketball court, instead of just the traditional foul-shot position. In this embodiment, the frame is adapted to swivel, as shown in FIG. 7. The swiveling frame includes, in addition to the hook portion 18, a rearward frame 60 adapted to lie adjacent the face of the backboard when the apparatus is hung over the backboard and receive the basket, preferably having an upper and lower rail similar to frame 6. The rearward frame 60 is connected to the forward frame 6 by way of an upper projection arm 62 and/or a lower projection arm 64 that project forwardly to the forward frame 6. The rearward end of each projection arm is rigidly connected to rearward frame 60. The forward end of the upper projection arm 62 is connected to the upper rail of forward frame 6 by an upper swivel joint 66. The forward end of the lower projection arm 64 is connected to the lower rail of forward frame 6 by a lower swivel joint 68. The upper and lower swivel joints are adapted so that the forward frame 6, along with all the components of the foul-shot return apparatus, other than the rearward frame and hooking means, may be swiveled in a nearly 180 degree arc about the basket, with the arc lying in a plane perpendicular to the face of the backboard. In order to provide enough space between the frame 60 and the frame 6 to allow for a sufficient arc for swiveling and to allow for a gap large enough to receive the basket between the frame 6 and frame 60, the upper and lower projection arms must extend forwardly a certain distance, preferably past the basket. If the basket is positioned inside the gap distance between the frames 6 and 60, it is necessary that the swiveling frame includes a ball deflector device 70 extending from the rearward frame 60 toward the lower rail of frame 6 to direct a ball falling through the basket into the ball collection chute 36. The ball deflector device may be a rigid material or it may be a flexible material extending from the lower rail of frame 60 to the lower rail of frame 6. Such a flexible material may be a single elastic sheet or a plurality of tube-like structures capable of extending and collapsing in length according to the swivel position. Various types of useful materials for forming a ball deflector device will become apparent to those in the art.

The rigid structure and arms of the present apparatus may be formed from any rigid material strong enough to resist bending under the intended use of the foul-shot return apparatus. In the interest of providing a lightweight apparatus easily attached to and dismantled from the backboard, the rigid material should be as lightweight as feasible. Preferred materials include plastic tubing, stainless steel tubing, aluminum, lightweight steel, and such. The web forming the ball collection chute may be any lightweight flexible material that is strong enough to resist tearing under the force of the ball bouncing through the chute. A slightly elastic material is preferable. Such materials include netting, natural and synthetic fabrics, films, and such, with the nylon netting typically used to form basketball goal baskets being preferable. It should be noted that the slight amount of elasticity in such web materials provides surprising results in that the ball maintains enough energy of motion that the ball keeps bouncing while travelling down the chute instead of stopping or getting caught in a snag, even when the web of the chute is not taunt.

The invention has been described in the specification and in the drawings in detail with particular reference to preferred embodiments thereof, but it will be understood that variations and modifications can be effected within the spirit and scope of the invention, with the scope of the invention being set forth in the following claims.

We claim:

1. A basketball foul-shot return apparatus for use with a basketball goal assembly elevated above a court including a backboard having a planar face and an upper end, and a basket extending forwardly from the face, said apparatus comprising:

(a) an elongated, rigid structure adapted for being adjacently positioned against the face of the backboard to receive the basket, said structure having a longitudinal axis perpendicular to the face of the backboard with a rearward end proximate to the backboard and a forward end distal to the backboard, said structure including a substantially rectangular frame having a size sufficient to receive the basket, said frame having upper and lower rails, first and second parallel side rails having upper and lower ends, and a hooking means connected to said frame, wherein said hooking means is adapted to engage the upper end of the backboard when the basket is received, and an elongated brace extending downwardly forward from a center point of said lower rail of said frame along said longitudinal axis to a forward end, and a rigid ball return mechanism positioned transverse to said longitudinal axis and having an upper end and a lower end wherein the lower end is pivotally connected to the forward end of said brace;

(b) first and so that second elongated arms having a rearward end and a forward end wherein the rearward end of each said arm is pivotally connected to the upper end of said corresponding first and second side rails of said frame so that said arms pivot through a pair of corresponding first and second essentially parallel planes lying on opposite sides of said longitudinal axis; and (c) a first and second means for locking connected to said corresponding first and second arms and engageable with said rigid structure so as to support said arms in a longitudinally extended position.

(d) a ball collection chute formed from a longitudinal web, said web having a rearward edge, a forward edge, and a pair of first and second opposed side edges, wherein said rearward edge is attached about the lower rail and first and second side rails of said frame, wherein said first and second side edges are attached to said corresponding first and second arms, said forward edge having a pair of first and second outer portions disposed on opposite sides of said longitudinal axis and a center portion disposed therebetween and intersected by said axis, wherein said center portion is attached to the lower end of said ball return mechanism and said first and second outer portions extend upwardly from said center portion to the corresponding forward ends of said first and second arms when said arms are positioned in said longitudinally extended position, wherein said basketball foul-shot return apparatus is elevated above the court when positioned on the backboard.

2. The apparatus of claim 1 having an absence of a supporting rigid member connected to the forward end of either of said first and second arms and extending downwardly to either said rigid structure or to the court.

3. The apparatus of claim 1 having an absence of a supporting rigid member connected to either of said first and second arms and extending downwardly to either said rigid structure or to the court at an angle essentially parallel to the face of said backboard.

4. The apparatus of claim 1 wherein said hooking means is a plurality of hooks each adapted to cup the upper end of said backboard, wherein said plurality of hooks is disposed on said frame on opposite sides of the longitudinal axis on a line parallel to the upper and lower rails of said frame.

5. The apparatus of claim 1 wherein said brace comprises a handle having an upper end connected to said brace and extending downwardly to a lower end disposed at an elevated position.

6. The apparatus of claim 1 wherein each of said first and second means for locking comprises an elongated cord having a first end attached to said corresponding arm and a second opposite end attachable to said rigid structure.

7. The apparatus of claim 1 wherein each of said first and second means for locking comprises a rigid locking hinge adapted to support said corresponding arm by bracing said arm against its corresponding side rail.

8. The apparatus of claim 1 wherein said ball return mechanism is an assembly including a ring defining an orifice having a size sufficient to receive a basketball and a return ramp connected to the lower end of said ring and extending downwardly forward from said ring whereby providing transport of a basketball through said return mechanism to a point proximate a foul-shot position.

9. The apparatus of claim 8 wherein said ramp is pivotably connected to said ball return ring so that said ramp is upwardly pivotable to a position whereat said ramp obstructs the passage of a basketball through the orifice of said ring.

10. The apparatus of claim 1 wherein said ball return mechanism is a ball retaining device.

11. The apparatus of claim 1 wherein said hooking means includes a pair of first and second hooks attached to the upper end of said corresponding first and second side rails of said frame, each of said hooks extending rearwardly from said frame to a first point rearward of said backboard where the hook extends downwardly to a second point where the hook extends transversely inward to form a bar lying transverse to said longitudinal axis and connecting said first and second hooks.

* * * * *